United States Patent [19]

Manzi

[11] Patent Number: 4,519,566

[45] Date of Patent: May 28, 1985

[54] HANGER DEVICE FOR LONG HANDLED IMPLEMENTS

[75] Inventor: Joseph Manzi, Bronx, N.Y.

[73] Assignee: Gossling Development Corporation, Bronx, N.Y.

[21] Appl. No.: 538,534

[22] Filed: Oct. 3, 1983

Related U.S. Application Data

[63] Continuation of Ser. No. 428,279, Sep. 29, 1982, abandoned.

[51] Int. Cl.[3] ..... A47B 91/00

[52] U.S. Cl. ..... 248/360; 248/110

[58] Field of Search ..... 248/359 I, 359 H, 359 G, 248/359 J, 359 R, 110; 220/91, 95; 211/65, 66, 67, 60 R

[56] References Cited

U.S. PATENT DOCUMENTS

| | | | |
|---|---|---|---|
| 847,053 | 3/1907 | Evans et al. | 248/359 G |
| 2,252,686 | 8/1941 | Baisden et al. | 220/95 |
| 2,271,189 | 1/1942 | Garthwait | 248/110 UX |
| 2,612,336 | 9/1952 | Tuttle | 220/91 X |
| 3,396,931 | 8/1968 | Eckstein | 248/280.1 |

FOREIGN PATENT DOCUMENTS

| | | | |
|---|---|---|---|
| 525453 | 1/1954 | Belgium | 248/359 H |

*Primary Examiner*—J. Franklin Foss

[57] ABSTRACT

A useful device such as a rotatable accessory for long-handled implements is provided to facilitate proper storage. The accessory comprises a fixed position part of metal or plastic secured by a screw to a handle end, a part of similar manufacture rotatable 360° around the fixed position part loosly held between the uppermost end of an implement handle and the secured part, a wire ball hanger part which pivots from side to opposing side of a handle end held by the rotatable part thus allowing the implement end of a handle be it mop, broom, rake or the like to always be in alignment with a projection which can accept the bail insuring an implement end of a handle will always rest parallel to a storage wall, and a spring part which gives tension to the bail and the rotatable part.

1 Claim, 7 Drawing Figures

FIG.5
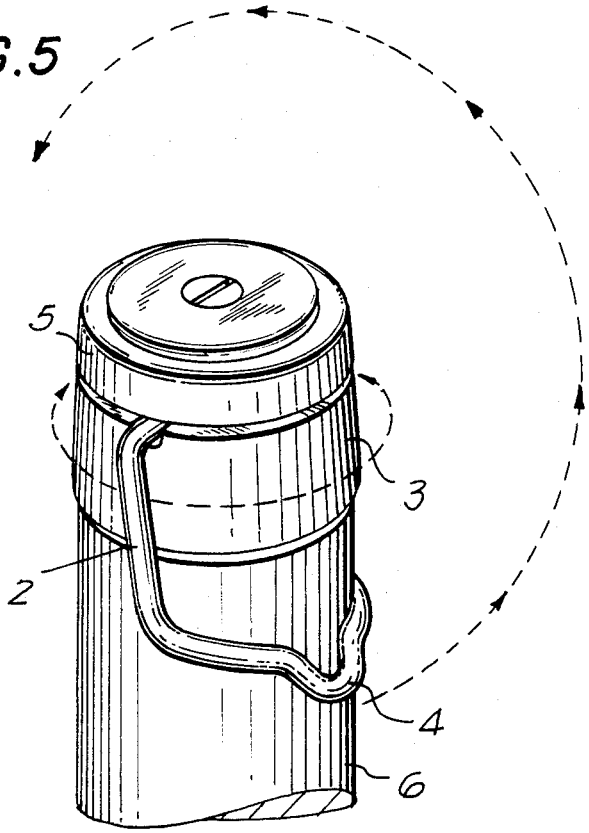
FIG. 6
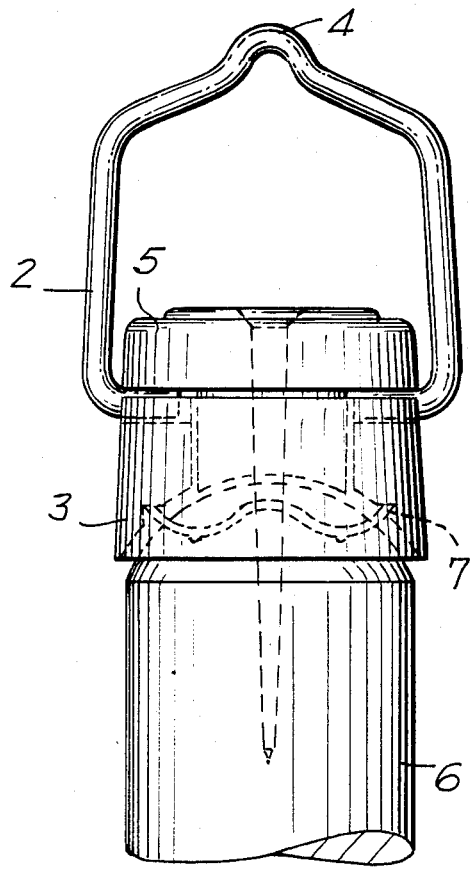
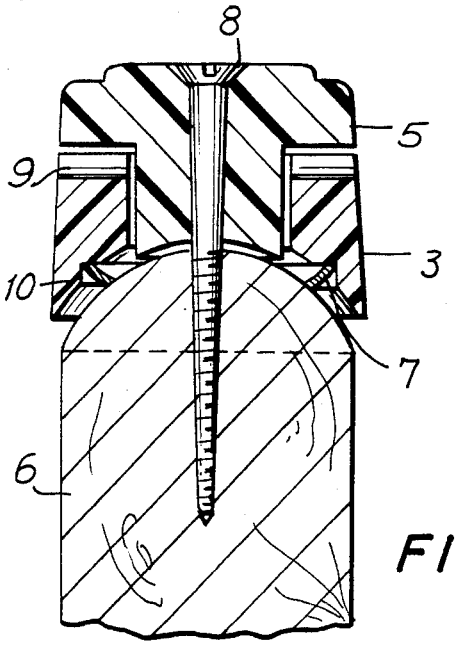
FIG.7

HANGER DEVICE FOR LONG HANDLED IMPLEMENTS

This is a continuation of application Ser. No. 06/428,279 filed 9/29/82 now abandoned.

OBJECTS AND SUMMARY OF THE INVENTION

It is an object of the invention to provide means to overcome a basic storage problem which characterizes long-handled implements such as mops, brooms, rakes and the like. The manufacturer supplied hanging facility for wood handled implements are a short term solution consisting of bent wire attached by force fitting bent ends into the top end of a wood implement handle. With use, the implement end will migrate around the implement handle causing the wire bail from which the implement is suspended to become un-usable obliging the user to abandon proper storage procedure by relegating implements to stacks or piles.

It is another object of the invention to provide a novel means for the bail to be made pivotal and rotational in it's seating. The Rotatable Hanger device allows the formed wire bail to pivot in any direction relative to the direction of the supporting rotating part thus giving to the implement handle a constant capacity for storage regardless of the migratory position of the implement-end around the handle. This novel means maintains at all times a strict and mutually necessary alignment between the handled implement and a storage wall and is acheived by means of a part which accomodates the bail and is rotatble around another part which is held in permanant position to the implement handle end. The rotatable part and the fixed position part can be manufactured of metal or plastic; each part is rounded in form at the base where said parts are in contact with round top-ends of implement handles.

Another object of the invention is to maximize engagement potential between implement hanger and storage means by providing a hanger bail wider at the base than manufacturer wire loops, enabling widening and elongating of the bail apex. Increasing the bail apex area facilitates centering the bail apex upon a hook or other receiving means which may vary from nail size to considerably larger.

A further object of the invention is to make the hanger part inobtrusive when the implement to which the hanger device is fastened is taken up for use. This is achieved by the unique shape of the hanger part; in rounding the part so that it conforms to the rounded shape of the implement handle, the hanger part falls half around the implement handle when the implement is in use. Further, the hanger bail can be pressed to the implement handle to remain rigid in that position untill it is prised up for storage, by means of the novel shaping at the apex of the formed hanger part.

With the above stated objects and other not readily apparent objects which will become more knowable as the overall character of the invention is better understood, the same generally consists of certain novel details of construction and specific combination of parts more fully described in the accompanying drawings and claims.

BRIEF DESCRIPTION OF THE DRAWINGS

FIG. 5 gives a perspective view of the invention mounted to an implement handle showing the hanger part at rest against the implement handle; the travel arc of the hanger part and the rotational travel directions of the support part in which the hanger bail is received is also shown.

FIG. 6 is an enlarged drawing of the invention fully assembled showing the working parts.

FIG. 7 is a section drawing showing the moulded component parts of the invention.

DETAILED DESCRIPTION OF THE DRAWINGS

Figure 1:
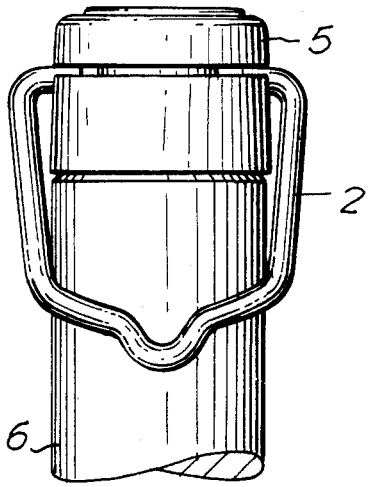
FIG. 1 is a front view of the implement hanger device attached to an implement handle with the formed bail hanger at rest against the implement handle.
Figure 2:
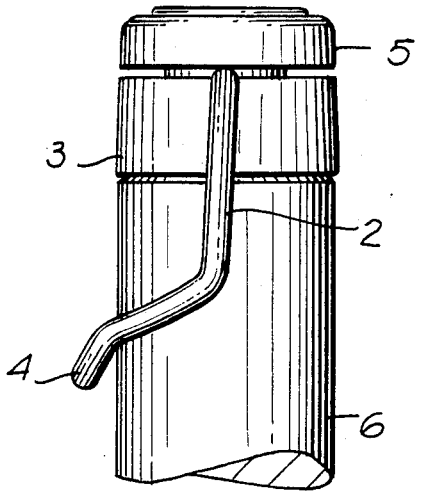
FIG. 2 is a side elevation of the device mounted to an implement handle with the hanger part as it appears when at rest against an implement handle.

Referring more patricularly to FIGS. 1 thru 7 the implement hanger of the invention is generally designated. The hanger device assembly is comprised of a wire bail (2) shaped so as to conform to the general roundness of implement handles which allows the bail to be pressed firmly against the implement handle when the implement is in use. FIGS. 1, 2 and 5 show the wire bail hanger part (2) pressed to the implement handle (6). Sufficient depth in the rounded aspect of the hanger bail part will allow the bail to be pressed onto the implement handle so that the bail remains tight against the handle and would require gentle prising to be disengaged from the handle when storage of the implement is desired. The hanger bail part is bent inward at either end which ends are received by openings (9-FIG. 7) in part no. 3 and has at the bail apex an accomodation (4) to allow best receptivity to hooks, nails or other means fitted to a wall for the purpose of storage of the implement. The downward aspect of the hanger bail (4) facilitates engagement of the bail to a storage means while allowing the bail to conform more fully to a rounded shape of an implement handle and also becomes the means for prising the hanger bail part away from an implement handle.

The invention further comprises no. 3 and 5 each of which can be moulded of plastic or metal. First part no. 5 is made stationary upon and held fast to an implement handle end by means of a screw driven thru an aperture (8) into the implement handle (6). FIGS. 5,6 and 7 show the accomodation (8) in first part no. 5 and the implement handle (6) for a wood screw. The device can be attached to shaft-metal implement handles by means of readily available self-tapping metal screws.

Figure 3:
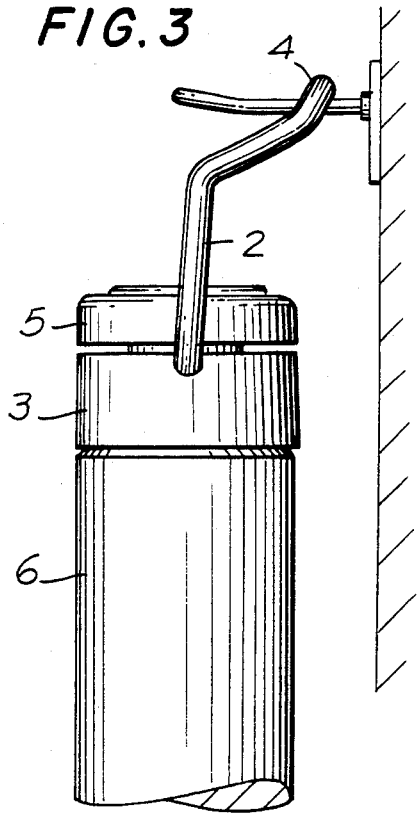
FIG. 3 shows the hanger part of the invention fully extended upward, from a side elevation, in storage position as it engages a wall-mounted bail receiver.
Figure 4:
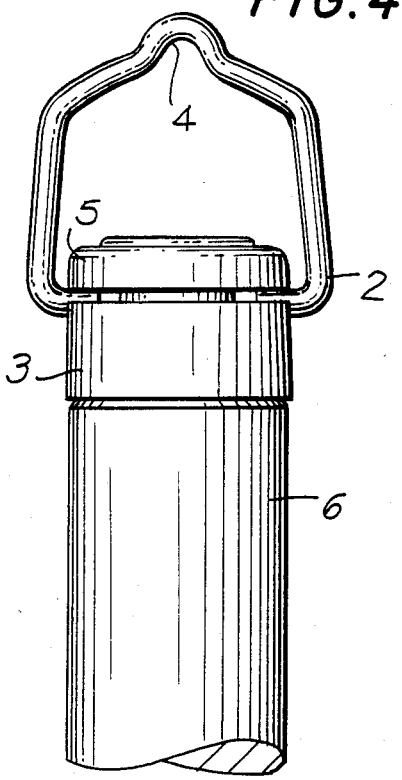
FIG. 4 is a front view of the device assembly attached to an implement handle with the hanger part extended upward.

The rotatable second part (3) is the means whereby the bail hanger part is enabled to maintain alignment with storage walls. FIG. 3 shows the hanger part fully extended and the implement handle end (6) to which it is attached suspended from a storage wall mounted projection.

A pair of slotted openings (9) extend across the upper aspect of the rotatable part of the hanger device (3) to provide pivotal bearing for the in-turned ends of the bail part (2); while said openings (9) suffice to receive the width of the in-turned bail ends, the height of the openings is to be less than the diameter of their width thereby allowing a slight protrusion of the bail ends above the upper aspect of the rotatable second part so as to provide a balance of bearing surfaces to abut the lower aspect of the fixed position first part (5) which aspect is directly above the slotted surface of the rotatable second part thereby facilitating near frictionless movement of the rotatable second part around the fixed position first part.

FIG. 7 illustrates a functionally significant differance between the inner height of part 5 and that of part 3. The fixed position part (5) is designed to engage tight with an implement handle end while the height dimension of the rotatable part (3) is designed to a lesser height than the component of the fixed part about which part 3 turns so as to accomodate a spring steel tension washer (7), additionally said height differance insures a degree of up and down manuverability of the rotatable part after installation of the device on an implement handle and also reduces the number of device sizes necessary of production in that a greater variety of rounded implement handle ends can be accomodated by a single size of device assembly.

FIG. 6 illustrates the tension unit; a spring steel tension washer (7) manufactured to a slightly greater dimension than the circumferance of the base of the fixed position part and has points of contact between the implement handle end and the seating aspect (10) of the rotatable part and is the means for imparting upward thrust to the rotatable part which in turn exerts pressure upon the bail thereby maintaining stability of said part in the seating (9) provided for in the rotatable part. Sharp projections incorporated in the tension washer (7) at the point of contact between washer and implement handle top-end will give a biting hold to the washer part into the wood or metal of a handle end thereby anchoring the washer part in place while a smooth surface on the opposite aspect of the washer will give a glide capacity to the rotatable part as the fixed position part (5) is firmly secured. FIG. 6 further illustrates the tension washer part seated within the cavity (10) provided in the base of the rotatable part (3); the washer is also shown as it abuts the implement handle end within the assembled device.

While there has been shown and described in this specification a preferred embodiment of the invention, it is to be understood that this embodiment is for the purpose of illustration and does not limit the invention in details of construction or application within the spirit of the invention, such modifications falling within the scope of the following claim;

What is claimed:

1. In a hanger device for long-handled implements, a first part of molded material having a bottom surface adapted to conform to the rounded end of implement handles and provided with a peripheral recessed area adapted to receive a rotating part and secured to a handle end by means of a screw, a second part of like manufacture rotatable around and below the cap portion of the secured part conforming to the round dimension of said part and the spherically shaped end of the top end of the implement handle, said second part being loosely held to allow rotation and having a groove traversing the upper surface thereof and a bail hanger conforming to and engaging upon the round shaft of a handle when the bail is in the lower position and having an outwardly projecting portion positioned at the apex to facilitate removal from engagement upon a handle and when upright to facilitate engagement upon a hook, said bail having portions at each end adapted to pivotally engage the groove of the rotating part, whereby the uppermost portions of the bail ends are always in contact with the rotating part and slidably engages the underside of the cap portion of the first part, a spring which seats within a circumferential depression of the rotating part, abuting the implement handle end providing an upward thrust to the rotating part which pressure maintains the bail in firm contact with the first part and the second part.

* * * * *